United States Patent [19]

Röck et al.

[11] Patent Number: 4,557,531

[45] Date of Patent: Dec. 10, 1985

[54] PULL-OUT GUIDE ASSEMBLY FOR DRAWERS OR THE LIKE

[75] Inventors: Erich Röck, Höchst; Helmut Hollenstein, Dornbirn, both of Austria

[73] Assignee: Julius Blum Gesellschaft m.b.H., Höchst, Austria

[21] Appl. No.: 599,827

[22] Filed: Apr. 13, 1984

[30] Foreign Application Priority Data

May 3, 1983 [AT] Austria ..... 1618/83

[51] Int. Cl.[4] ..... A47B 88/04

[52] U.S. Cl. ..... 308/3.8; 312/333; 312/341 R; 312/348

[58] Field of Search ..... 308/3.6, 3.8; 312/330 R, 334, 341 R, 348, 350, 335

[56] References Cited

U.S. PATENT DOCUMENTS

| | | | |
|---|---|---|---|
| 2,671,699 | 3/1954 | Vignos | 308/3.8 |
| 3,901,565 | 8/1975 | Hagen et al. | 312/332 X |
| 3,937,531 | 2/1976 | Hagen et al. | 312/348 X |
| 4,227,750 | 10/1980 | Röck et al. | 308/3.8 |
| 4,255,002 | 3/1981 | Röck et al. | 312/348 |
| 4,423,914 | 1/1984 | Vander Ley | 308/3.8 X |
| 4,436,357 | 3/1984 | Röck et al. | 308/3.8 X |

FOREIGN PATENT DOCUMENTS

| | | | |
|---|---|---|---|
| 996986 | 9/1976 | Canada | 312/341 |
| 3048756 | 10/1981 | Fed. Rep. of Germany . | |

*Primary Examiner*—Stuart S. Levy
*Assistant Examiner*—David Werner
*Attorney, Agent, or Firm*—Wenderoth, Lind & Ponack

[57] ABSTRACT

A pull-out guide assembly includes, for each side of a drawer, a pull-out rail, a support rail and an intermediate roller carrier together forming an inseparable unit. A locking member is provided on each drawer side wall and has a catch which secures the pull-out rail on the drawer side wall. The locking member also keeps the closed drawer in the closed position by clamping the support rail.

7 Claims, 3 Drawing Figures

PULL-OUT GUIDE ASSEMBLY FOR DRAWERS OR THE LIKE

FIELD AND BACKGROUND OF THE INVENTION

The invention relates to a pull-out guide assembly for drawers or the like, and of the type including on each side a supporting rail at the side of the body and a pull-out rail at the side of the drawer, a roller carrier being arranged between the supporting rail and the pull-out rail and carrying load-transmitting rollers and preferably compensating rollers for ensuring lateral stability of the pull-out guide assembly.

DESCRIPTION OF THE PRIOR ART

Two kinds of pull-out guide assemblies are known in the art in which the rollers are not directly fastened to the rails but are arranged in a separate roller carrier. Best known are the so called ball roller pull-out guides in which the load is transmitted between the rails by means of steel balls which are held in a roller carrier designed as a roller cage.

Such pull-out guides are very precise, i.e. they ensure excellent running of the drawer and permit at the same time good fitting of the drawer in the body, i.e. the drawer is laterally as well as vertically guided in a very stable manner. Such pull-out guide assemblies are employed particularly with high-quality furniture, e.g. office furniture.

A disadvantage of such pull-out guide assemblies is that the rails must have complicated profiles to define the rolling tracks for the balls. It is a further disadvantage that such pull-out guide assemblies do not provide a self closing effect, so a drawer which has not been correctly closed is not automatically fully pulled into the body but remains in the half-open position.

The other known type of pull-out guide assembly has been on the market for a short time only and has cylindrical rollers, namely of the same kind as normally mounted directly on the rails. Such pull-out guide assemblies also have very good running properties and can easily be provided with automatic closing means, but their stability, in particular the lateral stability, is not satisfactory. In the past, such pull-out guides have therefore been provided with lateral slides. This solution has never proved entirely satisfactory because it provides lateral alignment for the drawer in the inserted position only, but does not provide lateral stability of the drawer when the latter is being pulled out.

SUMMARY OF THE INVENTION

It is the object of the invention to provide an improved pull-out guide assembly of the above mentioned type, but which has the advantages of ball guiding means with respect to lateral stability, as well as the advantages of a pull-out assembly with cylindrical rollers, i.e. simple rail profiles, and a draw-in effect for a not fully closed drawer.

According to the invention this is achieved by providing the supporting rails and the pull-out rails with lateral front and rear stops so that the stops and the roller carriers form at each side of the drawer a unit which is movable relative to one another but which cannot be disassembled.

The pull-out guide assembly further has the advantage that it is supplied as a closed unit for the mounting of the piece of furniture and can be fastened to the body side wall. The drawer can, after the body of the piece of furniture has been completely mounted, be fitted onto the pull-out guide assembly, which substantially helps to facilitate furniture production.

The lateral stability of the pull-out guide assembly is obtained in a constructionally simple manner in that the supporting rails have Z-shaped profiles and the pull-out rails have U-shaped profiles with an upper outer vertical limiting flange.

Compensating rollers are mounted on the roller carrier between the limiting flange and a corresponding vertical flange of the supporting rail so that lateral guiding of the pull-out guide assembly is provided. It is advantageously provided that the supporting rails, the pull-out rails and the roller carriers are guided in one another without clearance.

To anchor the drawer securely on the pull-out rail, and, furthermore, to make the transmission of greater loads possible, it is provided in a conventional manner that the pull-out rails are held in grooves in the drawer side walls.

A preferred embodiment of the invention has at each side of the drawer a locking member for the pull-out rails which is fixed or moulded to the drawer side wall and carries a resilient bolt or catch which is adapted to engage behind a projection or in a recess of the pull-out rail.

In such a pull-out guide assembly, the drawer can easily be fitted onto the pull-out rails, and due to the resilient bolt the drawer is automatically locked in the inserted position. The locking member is preferably mounted at the front end of the drawer directly behind the front plate and has at least one lateral stop for the pull-out rail. Generally two lateral stops are provided, an upper and a lower one.

A special embodiment of this kind provides that the upper lateral stop extends between the central flange of the pull-out rail and the upper outer limiting flange.

When the locking member is designed as a separate member with respect to the drawer, the member may be provided with lateral bolts or plugs which project into holes located in the bottom of the recess receiving the pull-out rail. As a load acts on the pull-out rail, apart from the vertical load by the weight of the drawer, only in the direction of the depth of the drawer, simple locking means of this kind are sufficient.

A further embodiment provides that the locking members have stop cams for the running flanges of the supporting rails. The stop cams may be designed such that they form a kind of brake or holding means at the body rail, when the drawer is in the inserted position, so that the drawer is prevented from moving out of the body by itself and is always fully closed by the slight pressure which is necessary to press the drawer with the stop cams onto the body rail.

BRIEF DESCRIPTION OF THE DRAWINGS

Below an embodiment of the invention will be described in more detail with reference to the accompanying drawings, in which.

In the following description reference will be made only to one side of the drawer, and, hence, of the pull-out guide assembly, because the second side is obviously designed in an analogous manner as the mirror image thereof.

DESCRIPTION OF THE PREFERRED EMBODIMENT

The pull-out guide assembly according to the invention comprises on each side a supporting rail 1 at the side of the body and a pull-out rail 2 at the side of the drawer, with a roller carrier 3 mounted therebetween. Rollers 4 with horizontal axes of rotation are located in the roller carrier 3 and serve for the actual load transmission of the pull-out assembly. Compensating rollers 5 have vertical axes of rotation and are provided for the stabilization of the pull-out guide assembly and the drawer.

Figure 2:
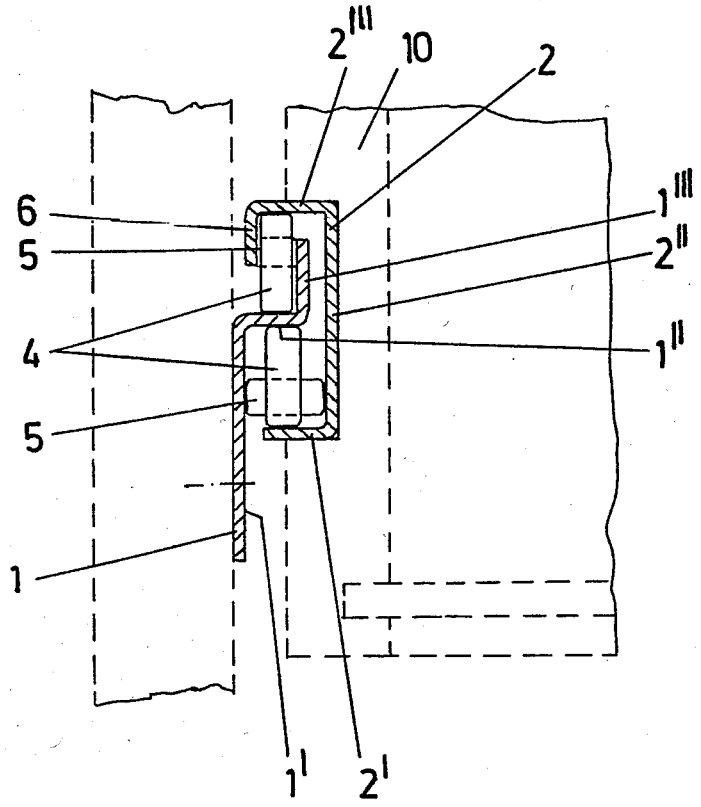
FIG. 2 is a vertical section through a drawer assembly according to the invention.
Figure 3:
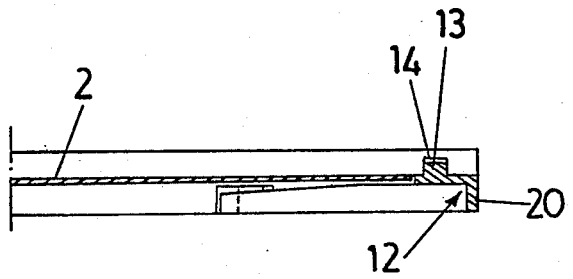
FIG. 3 is a horizontal sectional view of the front region of the pull-out rail and the locking member.

As can particularly be seen in FIG. 2, the supporting rail 1 is designed with a Z-shaped profile, a vertical flange 1' serving as a fastening flange and a second vertical flange 1''' as a lateral guiding flange. A central horizontal flange 1'' forms the actual running flange of the supporting rail 1.

The pull-out rail 2 has a U-shaped profile with two horizontal flanges 2', 2''' and a vertical central connecting flange 2'' and an outer limiting flange 6.

While the rollers 4 of the roller carrier 3 roll at the flange 2', 1'' and 2''', the compensating rollers 5 roll at the flanges 1', 2'' and 1''' and at the limiting flange 6. Since the supporting rail 1, the pull-out rail 2 and the roller carrier 3 are designed without clearance, the complete pull-out guide assembly is laterally stable.

Moreover, the supporting rail 1 is provided with a front stop 7, and the pull-out rail 2 with a rear stop 8, so that the pull-out rail 2 cannot be pulled unintentionally from the supporting rail 1.

In the illustrated embodiment, the supporting rail 1 is further provided with a rear stop 9.

The pull-out rail 2 is fastened in a groove in the drawer side wall 10. At the front end of such groove, directly behind a front plate 11 of the drawer, is arranged a locking member 12. In the illustrated embodiment, locking member 12 has two plugs or bolts 13 projecting into corresponding holes 14 in the bottom of the groove, thus holding the locking member 12 in the direction of the depth of the drawer.

The locking member 12 further has a resilient latch member 21 carrying a catch 15.

When the drawer has been fitted onto the pull-out rail 2, catch 15 engages in a recess 16 in the lower flange 2' of the pull-out rail 2, flange 2' having an angular portion or raised abutment 17 directly in front of the recess 16. Thus, the pull-out rail 2 is rigidly secured to the drawer.

Due to the fact that the pull-out rail 2 need not be fastened to the drawer side wall 10 in a conventional manner prior to the final mounting of the pull-out guide assembly and then fitted with side wall 10 onto the roller carrier 3 and the supporting rail 1, it is possible to design the complete pull-out guide assembly substantially without clearance, thus essentially improving the running properties of the pull-out guide assembly.

Since rollers 4 are formed of plastic material and steel balls are not required to be mounted in the roller carrier 3, the rails 1, 2 may be coated in any desired manner.

Figure 1:
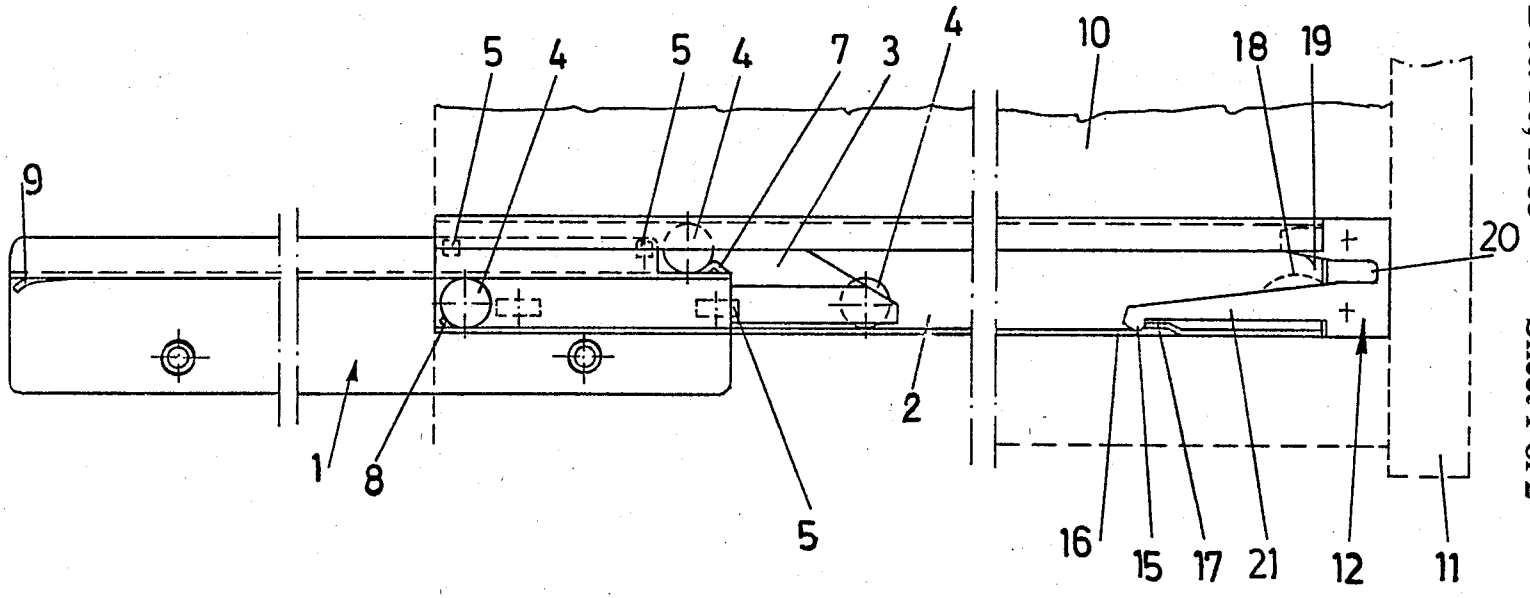
FIG. 1 is a side view of a pull-out guide assembly with the drawer in the closed position.

In FIG. 1 dotted lines show a stop cam 18 on the resilient latch 21. Cam 18 clamps the stop 7 of the running flange 1'' of the supporting rail 1 when the drawer is in the closed position.

The locking member 12 further has an upper lateral stop 19 which projects between the vertical flange 2'' and the limiting flange 6 of the pull-out rail 2 when the pull-out rail 2 has been pushed in.

At the front end, the locking member 12 is provided with a flange 20 which defines the end of the inserting path of the drawer.

What is claimed is:

1. In a pull-out guide assembly for use on each of opposite sides of a drawer in an article of furniture of the type wherein the drawer is slidably insertable into and removable from a furniture body, said assembly being of the type including a supporting rail to be mounted on a respective side of the body, a pull-out rail to be mounted on a respective side of the drawer, a roller carrier mounted between said supporting and pull-out rails, load transmitting rollers carried by said roller carrier and running on horizontal flanges of said supporting and pull-out rails, and compensating rollers carried by said roller carrier and running on vertical flanges of said supporting and pull-out rails for providing lateral stability to said assembly, the improvement comprising:

stop means on a front end of said supporting rail and on a rear end of said pull-out rail for preventing disassembly of said supporting and pull-out rails and said roller carrier by relative longitudinal movement therebetween, and thereby for forming said supporting and pull-out rails into an inseparable unit which may be mounted on the respective side of the furniture body;

said supporting and pull-out rails, said roller carrier and said load transmitting and compensating rollers being dimensioned and positioned for relative longitudinal movement substantially without lateral or vertical clearance; and means for, after said inseparable unit has been mounted on the respective side of the furniture body, connecting said pull-out rail to the respective side of the drawer without the use of screws or bolts, said connecting means comprising a locking member including a resilient latch member having a catch fitting onto said pull-out rail and at least one integral member extending laterally from said locking member for removable friction fit into a hole provided in the respective drawer side.

2. The improvement claimed in claim 1, wherein said supporting rail has a Z-shaped profile including inner and outer vertical flanges joined by a horizontal flange, and said pull-out rail has a generally U-shaped profile including lower and upper horizontal flanges joined by an inner vertical flange and an outer limiting flange extending vertically downwardly from said upper horizontal flange and spaced from said lower horizontal flange.

3. The improvement claimed in claim 1, wherein said pull-out rail has therein a recess and a raised abutment, and said catch fits within said recess with said latch member abutting said raised abutment.

4. The improvement claimed in claim 1, wherein said locking member includes two said integral members.

5. The improvement claimed in claim 1, wherein said integral member comprises a plug.

6. The improvement claimed in claim 1, wherein said locking member further includes a stop member extending longitudinally into said pull-out rail and extending laterally between respective vertical flanges thereof.

7. The improvement claimed in claim 1, wherein said locking member further comprises means for, upon the drawer being moved fully into the furniture body, clamping said stop means on said front end of said supporting rail.

* * * * *